United States Patent [19]

Imaizumi et al.

[11] Patent Number: 4,592,642

[45] Date of Patent: Jun. 3, 1986

[54] DEVELOPING MATERIAL AMOUNT DETECTING APPARATUS

[75] Inventors: Masaru Imaizumi, Shinshiro; Kenzou Tanaka, Toyokawa, both of Japan

[73] Assignee: Minolta Camera Kabushiki Kaisha, Osaka, Japan

[21] Appl. No.: 726,770

[22] Filed: Apr. 24, 1985

[30] Foreign Application Priority Data

Apr. 28, 1984 [JP] Japan ..... 59-87600

[51] Int. Cl.[4] ..... G03G 15/08

[52] U.S. Cl. ..... 355/3 DD; 355/14 D; 222/64; 430/122; 118/657

[58] Field of Search ..... 355/3 DD, 14 D; 222/64, 222/222; 430/120, 122; 118/657

[56] References Cited

U.S. PATENT DOCUMENTS

| | | | |
|---|---|---|---|
| 4,026,643 | 5/1977 | Bergman | 355/14 D |
| 4,200,665 | 4/1980 | Suzuki et al. | 355/14 D |
| 4,210,864 | 7/1980 | Miyakawa et al. | 355/3 DD |
| 4,270,487 | 6/1981 | Terashima et al. | 355/3 DD |
| 4,277,003 | 7/1981 | Tabuchi et al. | 222/350 |
| 4,341,461 | 7/1982 | Fantozzi | 355/14 D |
| 4,348,100 | 9/1982 | Snelling | 355/14 D X |
| 4,506,804 | 3/1985 | Oka | 222/64 |

FOREIGN PATENT DOCUMENTS

| | | |
|---|---|---|
| 55-36844 | 8/1980 | Japan . |
| 58-136068 | 8/1983 | Japan . |

*Primary Examiner*—A. C. Prescott

*Attorney, Agent, or Firm*—Wenderoth, Lind & Ponack

[57] ABSTRACT

A developing material amount detecting apparatus for detecting an amount of developing material contained in a tank includes a detection member provided inside the tank movably between a settled position and a raised position, toner feeding vane for periodically sending the detection member from the settled position to the raised position, and a switch which turns on when the detection member is held substantially in the settled position and turns off when the detection member is held substantially in a position other than the settled position. The apparatus further includes a timer for counting a predetermined time length. The timer starts counting when the switch is turned off. When the switch is maintained off for a time length longer than the predetermined time length, it is indicated that the amount of developing material inside the tank is more than a predetermined amount.

9 Claims, 9 Drawing Figures

DEVELOPING MATERIAL AMOUNT DETECTING APPARATUS

BACKGROUND OF THE INVENTION

1. Field of the Invention

The present invention relates to a developing material amount detecting apparatus for use in an electrographic copying machine.

2. Description of the Prior Art

Generally, in an electrographic copying machine, the developing material, particularly toner is consumed each time the copying operation is carried out. Thus, it is necessary to supply toner into the developing apparatus from the supply tank at an amount equal to the amount consumed for developing, and also, it is necessary to load the supply tank with toner when the amount of toner contained in the supply tank becomes small. To this supplying and loading, it is necessary to detect the amount of developing material contained in the developing tank of the developing apparatus and/or in the supply tank.

According to the prior art, the detection of the amount of developing material is done by a pressure sensor or magnetic sensor provided in the wall of the tank. However, such a sensor is expensive, and the detection by such a sensor has low stability and low reliability.

An improved apparatus for detecting the amount developing material has been proposed, such as disclosed in U.S. Pat. No. 4,277,003 issued July 7, 1981 to Tabuchi et al. According to this reference, a stirring member is provided movably inside the tank and it is forced to moved intermittently against a force by a biasing means. The developing material amount detecting apparatus disclosed in this reference generates a signal representing the amount of decrease of the developing material in response to a position at which the stirring member returns upon removal of the force.

The above described developing material amount detecting apparatus is based on the fact that the returning of the stirring member by the biasing means is restricted by the developing material contained in the tank, whereby the returned position of the stirring member indicates the amount of the developing material remaining in the tank. Since the returned position of the stirring member can be detected using microswitches or the like, the detection which is based on the on and off operation of the microswitch is very stable and, yet, the detecting apparatus can be manufactured at low cost when compared with the prior art detecting apparatus employing the pressure sensor or magnetic sensor. However, according to the above described detecting apparatus, since the remaining amount of the developing material is detected merely by the returned position of the stirring member, the detected amount is not very precise and, therefore, the problem still exists in the reliability. Furthermore, the detected amount depends on the size and configuration of the stirring member and also on the strength of the biasing means, the relationship between the returned position of the stirring means and the amount of remaining developing material in the tank is not necessarily the same among a number of developing material amount detecting apparatuses. Therefore, precise adjustments are needed in each developing material amount detecting apparatus by changing the various settings in trial and error attempts, resulting in a time consuming and difficult task.

SUMMARY OF THE INVENTION

The present invention has been developed with a view to substantially solving the above described disadvantages and has for its essential object to provide an improved developing material amount detecting apparatus which can detect the amount of developing material with a high accuracy and, at the same time, the setting and adjustment of the detected amount can be done simply.

In accomplishing these and other objects, developing material amount detecting apparatus according to the present invention comprises a detection member provided to move reciprocatingly between a first position and a second position inside a developing material tank, means for urging the detection member towards the first position, means for periodically sending the detection member from the first position to the second position, and means for detecting, during the time when the sending means is actuated, the amount of developing material relative to the time during which the detection member is located at the first position.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

According to the embodiment described below, the developing material amount detecting apparatus according to the present invention is provided in a toner supply tank 6 as an apparatus for detecting the amount of toner as being empty.

Figure 1:
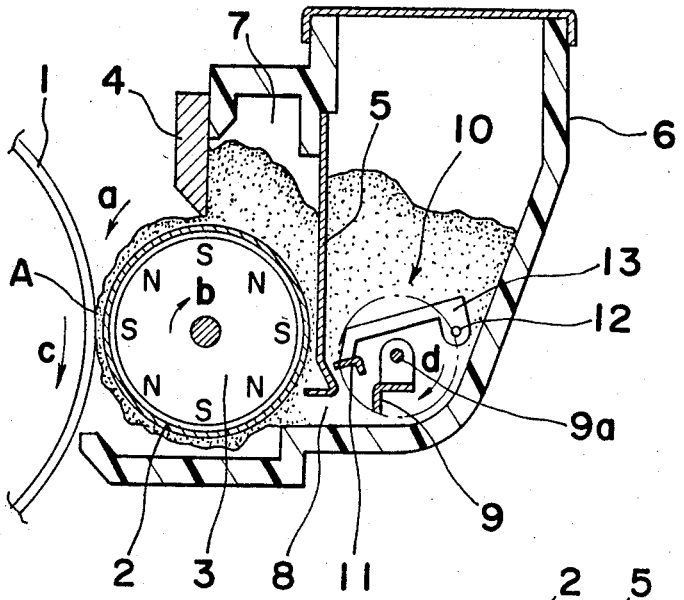
FIG. 1 is a cross-sectional view schematically showing the embodiment of the developing material amount detecting apparatus according to the present invention.

Referring to FIG. 1, the developing apparatus includes a developing sleeve 2 to which magnetic particles (magnetic carriers) are previously applied. More specifically, the developing apparatus comprises developing sleeve 2 which is defined by a hollow cylinder made of non-magnetizable electrically conductive material, a rotary magnet or multipolar magnet member 3 rotatably and coaxially enclosed in a developing sleeve 2 with S and N poles occuring alternately around its outer periphery, and a plate 4 defining a predetermined narrow space between its edge and the outer surface of developing sleeve 2. The developing material, which is a mixture of magnetic carriers and electrically non-conductive magnetizable toner, moves in a direction as indicated in FIG. 1 when magnet member 3 is rotated in a direction b and, at the same time, developing sleeve 2 is rotated in a direction a. Accordingly, approximately constant thickness of the developing material is provided on developing sleeve 2 after plate 4.

Provided adjacent developing sleeve 2 is a separation wall 5 for separating the space provided within the developing apparatus described above from a space defining toner supply tank 6. As shown in FIG. 1, the bottom end of separation wall 5 is provided with a supply opening 8 for sending the toner from toner supply tank 6 to the developing apparatus. A space 7 defined above developing sleeve 2 and between plate 4 and wall 5 is provided to store the magnetic carriers.

The toner empty detecting apparatus 10 is provided at the lower part of toner supply tank 6 together with a toner feeding vane 9, which rotates in a direction d about a shaft 9*a*.

By the developing apparatus described above, a latent image formed on a surface of photoreceptor drum 1 can be developed into a visible image through the steps described below. At the very beginning, the magnetic carriers are loaded into space 7 and, thereafter, magnet member 3 and developing sleeve 2 are driven for the preparatory operation. Then, electrically non-conductive magnetizable toner is loaded into toner supply tank 6. At this stage, it is permissible that some toner is already mixed in the magnetic carriers in space 7. Now, it is ready to develop the latent image on the photoreceptor surface.

When magnet member 3 rotates in the direction b and developing sleeve 2 rotates in the direction a at predetermined speeds, respectively, electrically non-conductive magnetizable toner moves along the surface of developing sleeve 2 in the direction a. When toner moves past space 7, it is mixed and agitated with magnetic carriers. Thus, toner and magnetic carriers are electrostatically charged by the frictional contact therebetween. As a result of mixing and agitation at this stage, the ratio of electrically non-conductive magnetizable toner to magnetic carrier is constant, so that at developing region A, toner is favorably transferred onto the drum surface as the drum rotates in the direction c, thereby producing a visible image of good quality. The residual developing material on the developing sleeve 2 is transported to supply opening 8 at which toner is supplied, thereby reviving the developing material.

Figure 2:
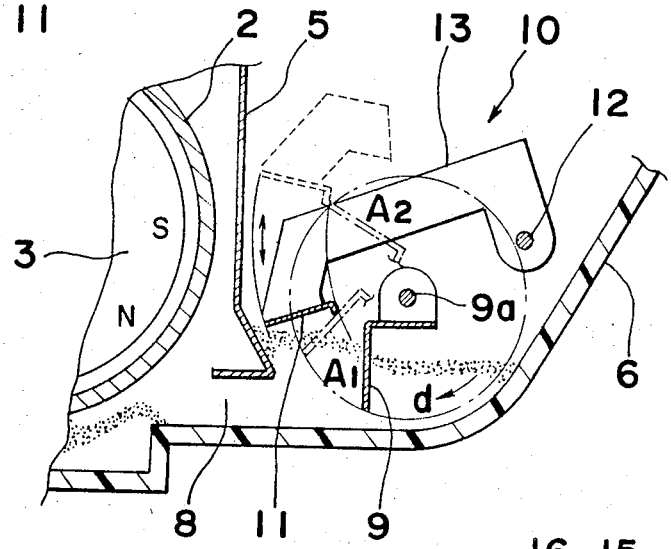
FIG. 2 is a cross-sectional view showing a portion of FIG. 1 on an enlarged scale.

Referring now to FIG. 2, the description is directed to toner empty detecting apparatus 10, which is located at the bottom portion of toner supply tank 6.

Toner empty detecting apparatus 10 comprises empty fdetection plate 11 which is provided at one end of lever 13. The other end of lever 13 is connected to a shaft 12 which is rotatably journalled at the opposite side walls of the toner supply tank 6. A suitable stopper means (not shown) is provided for restricting the rotation of lever 13 in the counterclockwise direction, and thus, lever 13 is normally held in a first position indicated by a real line, in FIG. 2. Toner feeding vane 9, which rotates in a direction d about shaft 9*a*, comes into contact with empty detection plate 11 when it is moved to a position A1, indicated by a chain line in FIG. 2. Further rotation of toner feeding vane 9 provides upward pushing force to empty detection plate 11. Therefore, empty detection plate 11 rotates upwardly from the first position A1 about shaft 12 in accordance with the clockwise rotation of toner feeding vane 9. Since the rotation radius of empty detection plate 11 is greater than that of toner feeding vane 9, and since the rotation axis (shaft 12) of plate 11 is located above the rotation axis (shaft 9*a*) of toner feeding vane 9, empty detection plate 11 can be raised only up to a second position indicated by a dotted line, at which toner feeding vane 9 is located at a position A2. Thereafter, toner feeding vane 9 disengages from empty detection plate 11 and, therefore, empty detection plate 11 returns from the second position to the first position by its own weight.

During the return of the empty detection plate 11 to the first position, empty detection plate 11 receives no or hardly any resistance of toner if toner supply tank 6 is empty or has very little toner. Thus, in this case, empty detection plate 11 moves down smoothly.

On the contrary, if toner supply tank 6 has much toner, empty detection plate 11 moves down slowly against the resistance of toner. In some cases, before empty detection plate 11 reaches the first position, it may be pushed up again by the next rotation of toner feeding vane 9.

Figure 3:
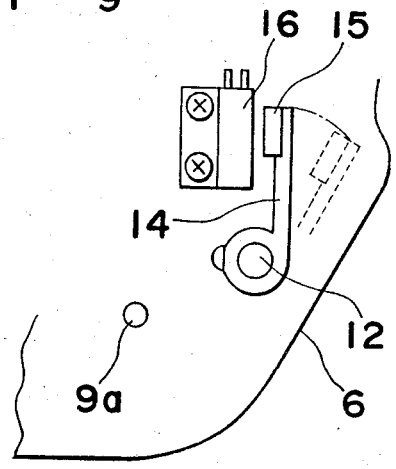
FIG. 3 is a side elevational view of the portion shown in FIG. 2, viewed from the outside.

Referring to FIG. 3, shaft 12, which is connected to empty detection plate 11, extends through the side wall of toner supply tank 6 and is firmly connected to a lever 14. A magnet 15 is provided at the end of lever 14. Thus, in accordance with the pivotal movement of empty detection plate 11 between the first and second positions, magnet 15 also moves between a first position shown by a real line in FIG. 3 and a second position shown by a dotted line. A reed switch 16 is provided on the outside of the side wall of toner supply tank 6 at such a position that reed switch 16 turns on when magnet 15 is in its first position, and turns off when magnet 15 is in its second position. According to the preferred embodiment, reed switch 16 turns off when magnet 15 immediately leaves the first position, and it turns on when magnet 15 comes very close to reed switch 16. Next, the operation of reed switch 16 will be described in connection with the movement of empty detection plate 11.

Figure 4:
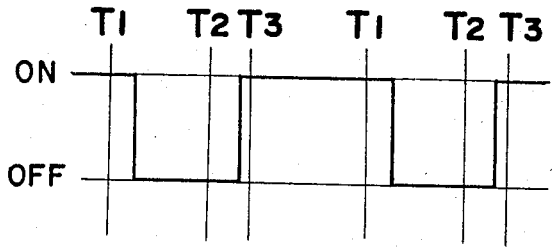
FIGS. 4, 5*a* and 5*b* show waveforms produced from a reed switch.

Referring also to FIG. 4, at time T1, it is assumed that toner feeding vane 9 is located at position A1 (FIG. 2) and, therefore, empty detection plate 11 is located at its first position. Thus, reed switch 16 is on. Then, when empty detection plate 11 moves away from the first position and is located a short distance from the first position, reed switch 16 turns off. At time T2, toner feeding vane 9 is located at position A2 and, thereafter, empty detection plate 11 starts to drop from the second position to the first position. When empty detection plate 11 reaches a position very close to the first position, reed switch 16 turns on again. Then, at time T3, empty detection plate 11 returns to the first position. Then, at the second time T1, toner feeding vane 9 completes one rotation and is again located at position A1. Therefore, as long as the speed of rotation of toner feeding vane 9 is constant, one cycle period, such as between the first T1 and the second T1, is constant. In other words, in the chart of FIG. 4, the positions of times T1 and T2 do not change in spite of the difference in the amount of toner remaining in toner supply tank 6. Only the position of time T3 changes such that it moves away from time T2 as the amount of toner contained in the tank becomes greater.

Figure 5A:
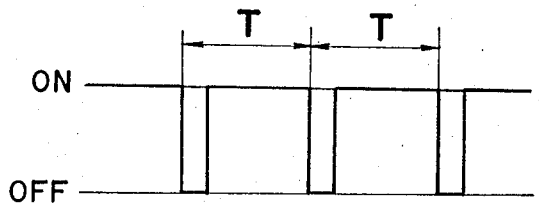
Figure 5B:
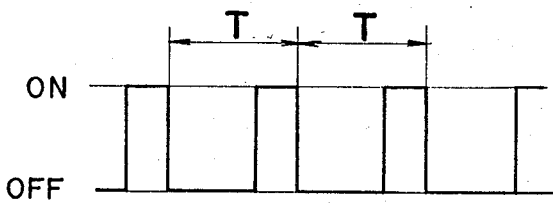

As understood from the foregoing description, a time length between times T2 and T3 is dependent on the amount of toner left in toner supply tank 6. If the amount of toner remaining in the toner supply tank is small, time T3 comes immediately after time T2 and, therefore, a time length between times T2 and T3 is short. Thus, the ON period will become relatively long, such as shown in FIG. 5*a*. However, if much toner is still remaining in the tank, the time length between times T2 and T3 becomes rather long, resulting in a short ON period, such as shown in FIG. 5*b*. In FIGS. 5*a* and 5*b*, T represents one cycle period, which is equal to the time length between first time T1 and the second time T2, and also equal to a time length for effecting one rotation of toner feeding vane 9. If toner feeding vane 9 has two wings, T represents a time length for effecting a half rotation of toner feeding vane 9. If there are three wings, T represents a time length for effecting a ⅓ rotation of toner feeding vane 9.

Accordingly, by the detection of the ON period and OFF period of reed switch 16 it is possible to ascertain the amount of toner contained in the supply tank. Such a detection may be done by the detection of a duty ratio, which is equal to the ratio of the ON period or OFF period to one cycle length. According to a preferred embodiment, suitable reference ON and reference OFF periods may be set in a manner as described below. When a detected ON period or OFF period represents a certain small amount of toner remaining in the supply tank, it may be deemed as a reference period indicating the emptiness of supply toner tank. Then, such a reference period is compared with a newly obtained ON period or OFF period for the detection of whether or not the toner in the supply tank is empty.

Figure 6:
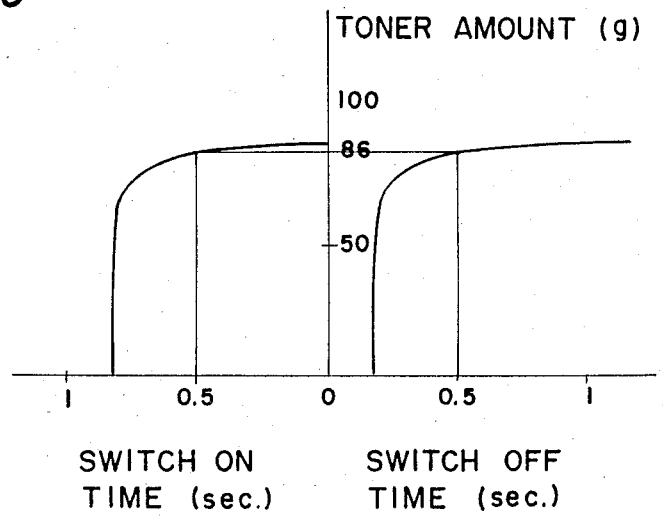
FIG. 6 is a graph showing on and off operation of the reed switch effected relative to the amount of toner contained in the tank.

Referring to FIG. 6, a graph is illustrated for showing a change of ON and OFF periods of reed switch 16 in accordance with the change of amount of toner contained in the toner supply tank 6. The graph is obtained under the condition such that the toner feeding vane 9 is rotated at a speed of 60 rpm and, therefore, empty detection plate 11, as well as magnet 15, reciprocates once every second. In other words, one cycle period is equal to 1 second. As apparent from the graph of FIG. 6, the length of the ON period or OFF period changes abruptly when the amount of toner contained in the tank is at about 80 grams. When the amount of toner in the tank is more than 90 grams, the OFF condition continues, and if it is less than 70 grams, there will be hardly any change in the ON and OFF periods. As apparent from the graph of FIG. 6, when the ON and OFF periods are both equal to 500 milliseconds, the toner contained in the supply tank is about 86 grams, which can be considered as empty. Thus, the ON and OFF periods of 500 milliseconds, respectively, can be used as reference ON and OFF periods. It is to be noted that the curves depicted in FIG. 6 are merely an example, and, therefore other graphs, which may be obtained by the change of size of empty detection plate 11, by the change of the installing position of toner empty detecting apparatus 10, or by the change of any other factors, may be used. Therefore, it is possible to select different reference ON and OFF periods or to select a different amount, besides 86 grams, as the amount which is deemed as empty.

Next, the operation of the embodiment of the developimg material amount detecting apparatus according to the present invention will be described below with reference to a flow chart.

Figure 7:
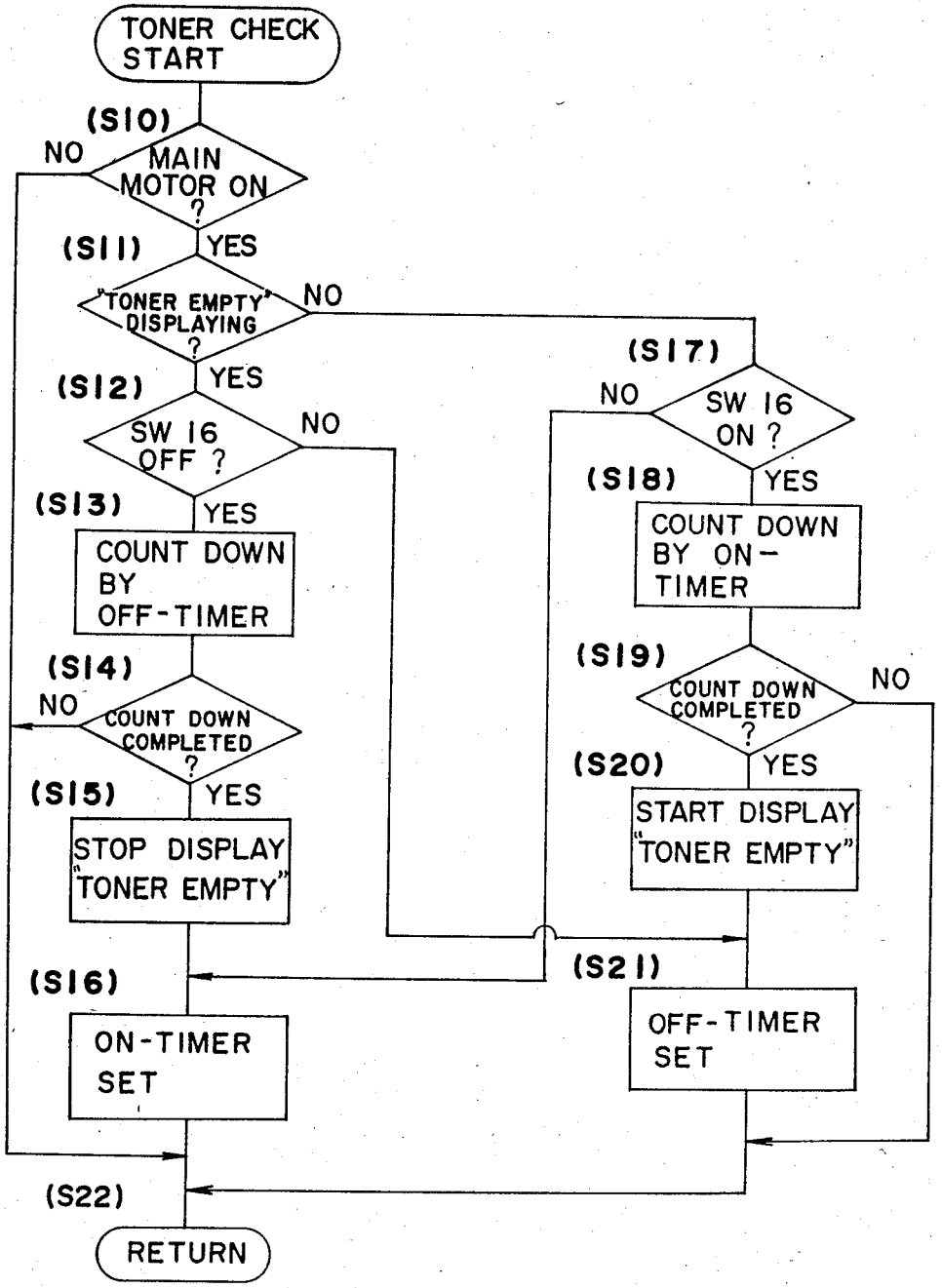
FIG. 7 is a flow chart showing an operation of the embodiment of the developing material amount detecting apparatus according to the present invention.

Referring to FIG. 7, a routine for detecting the remaining amount of toner in toner supply tank 6 is effected by a microcomputer (not shown) as one of various copying operations, and is repeated with a cycle length of 10 milliseconds.

At step S10, it is detected whether or not a main motor (not shown) is on. If the main motor is not on, the program goes to return for not carrying out any detection operation. This is because toner feeding vane 9 as well as the developing apparatus is driven by the main motor. Therefore, when the main motor is not powered on, toner empty detecting apparatus 10 will not operate. If the main motor is on, the program goes to step S11 at which it is detected whether or not the "TONER EMPTY" display is on. This step S11 is to detect the result of the detection carried out in the previous cycle. If the "TONER EMPTY" is being displayed, it means that the emptiness of toner is already detected in the previous cycle. Then, at step S12, it is detected whether switch 16 is off or not. If switch 16 is off, the program goes to step S13 at which an OFF-timer provided in the microcomputer starts the countdown, or continues the countdown, if it has already been started. The OFF-timer according to this embodiment is a down-counter set to count the OFF-period of switch 16, and it can count, at the maximum, 500 milliseconds.

Next, at step S14, it is detected whether or not the OFF-timer has counted down to zero. If the countdown is still being carried out, the program goes to return (S22) and repeats steps S10, S11, S12, S13, S14 and S22. After repeating this routine for a number of times and when the OFF-timer has counted down to zero, it means that switch 16 is held off for 500 milliseconds or more, indicating that the toner in the supply tank is more than 86 grams. Since emptiness of toner was detected in the previous cycle, but now it is indicated that toner is more than 86 grams, it is understood that toner is re-loaded in the supply tank. Thus, at next step S15, the display of "TONER EMPTY" is cancelled. Then, at step S16, an ON-timer is set, thereby making the ON-timer ready for use in the following cycle of operation if required.

However, when the OFF-timer stops the countdown before it reaches zero during the repeat of steps S10, S11, S12, S13, S14 and S22, the program goes from step S12 to step S21, thereby setting the OFF-timer and making it ready to start the countdown from the beginning. Thereafter, while switch 16 is on, the program repeats steps S10, S11, S12, S21 and S22. Then again, when switch 16 is turned off, the program repeats steps S10, S11, S12, S13, S14 and S22. In this manner, the display of "TONER EMPTY" is maintained. During the repeat of the above and when toner is re-loaded, the program goes from step S14 to step S15 for cancelling the display of the "TONER EMPTY", as described above.

Next, at step S11, if it is detected that "TONER EMPTY" is not being displayed, the program goes to step S17, at which it is detected whether switch 16 is on or not. If switch 16 is off, the program goes to step S16 at which an ON-timer provided in the microcomputer is set, ready for the countdown from the beginning. The ON-timer according to this embodiment is a down-counter set to count the ON-period of switch 16, and it can count, at the maximum, 500 milliseconds. Thereafter, so long as switch 16 is off, the program repeats steps S10, S11, S17, S16 and S22.

When switch 16 turns on during this repeat, the program goes from step S17 to step S18, thereby starting the countdown by the ON-timer. Then, at step S19, it is detected whether ON-timer has counted down to zero, or not. If not, then the program goes to return. Under this condition, and while the countdown is carried out by the ON-timer, the program repeats steps S10, S11, S17, S18, S19 and S22. If the countdown stops before the ON-timer counts down to zero due to the change of switch 16 from on to off, the program goes from step S17 to step S16, thereby making the ON-timer ready for counting from the beginning. In this case, since the ON-period is shorter than 500 milliseconds, it is understood that toner in the supply tank is more than 86 grams. Then, the program repeats steps S10, S17, S16 and S22.

While repeating steps S10, S11, S17, S18, S19 and S22, if the ON-timer has counted down to zero, indicating that the ON-period is longer than 500 milliseconds, the program goes to step S20. In this case, it is understood that the supply tank has less than 86 grams and, therefore, at step S20, "TONER EMPTY" is displayed. Then, the program goes to step S21 for setting the OFF-timer for use in the following cycle of operation if required.

Thereafter, in summary, the program repeats steps S10, S11, S12, S13, S14 and S22, and then, repeats steps S10, S11, S12, S21 and S22 until toner is loaded again, in the manner as described above. When toner is loaded, the program repeats steps S10, S11, S12, S13, S14 and S22, and finally follows steps S10, S11, S12, S13, S14, S15, S16 and S22, so as to cancel the display "TONER EMPTY". Thereafter, the program repeats steps S10, S11, S17, S16 and S22, and then, repeats steps S10, S11, S17, S18, S19 and S22. During this repeat, if the amount of toner becomes less than the required amount, such as 86 grams, the program follows steps S10, S11, S17, S18, S19, S20, S21 and S22. Accordingly, "TONER EMPTY" is displayed again.

Figure 8:
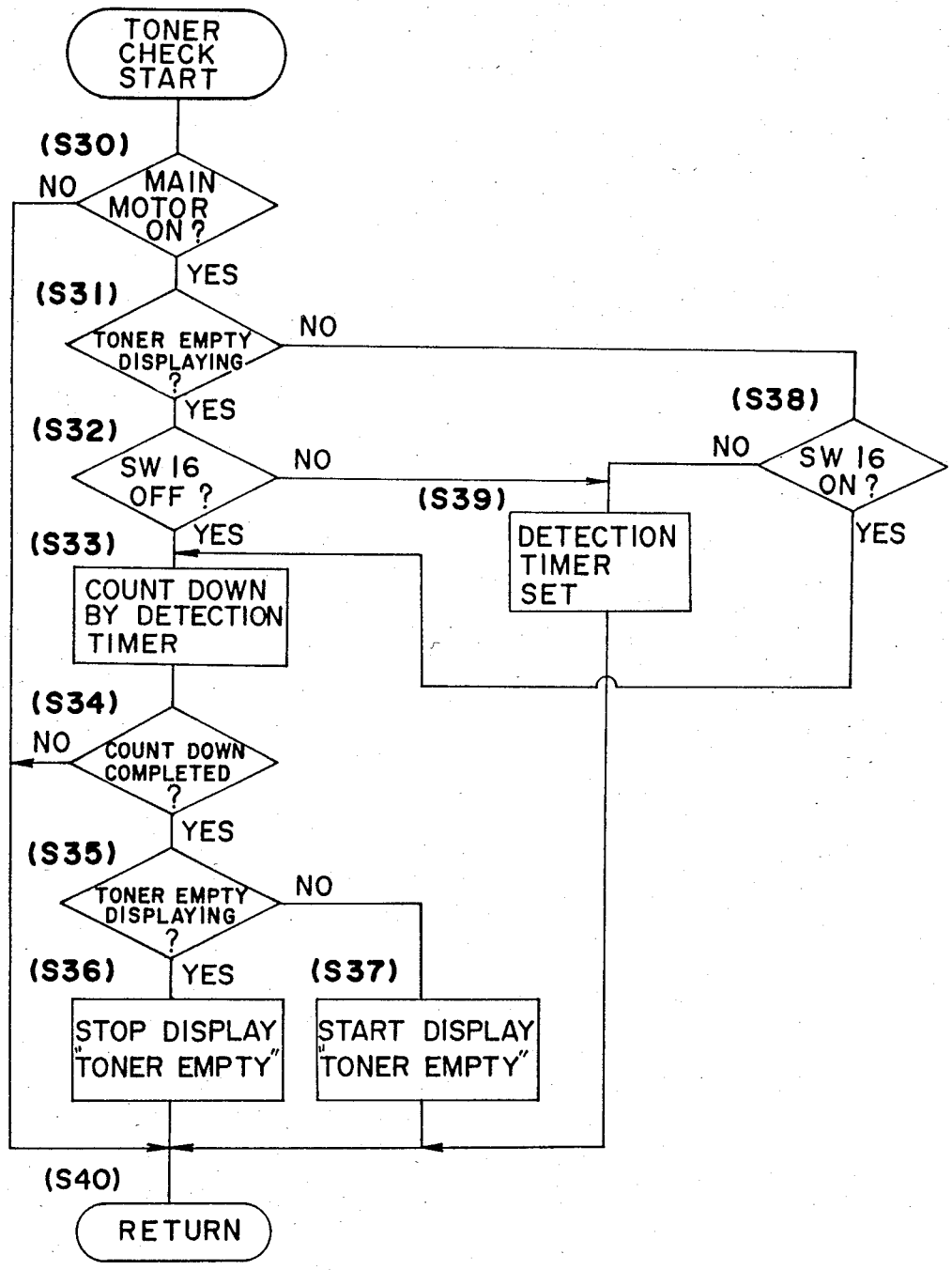
FIG. 8 is a flow chart showing a modification of FIG. 7.

Referring to FIG. 8, a modification of the flow chart is shown. In the flow chart of FIG. 7, the ON-timer and OFF-timer are both used for counting the same period of time, 500 milliseconds, but in the flow chart of FIG. 8, only one timer, referred to as a detection timer, is employed for counting the ON-period and OFF-period of switch 16. The detection timer according to this modification is also a down-counter set to count the OFF- and ON-periods of switch 16, and it can count, at the maximum, 500 milliseconds.

Referring to FIG. 8, steps S30, S31 and S32 are the same as steps S10, S11 and S12 described above. Thus, when it is detected that the main motor is on at step S30, a detection is made at step S31 whether or not "TONER EMPTY" is displaying. If the "TONER EMPTY" is being displayed, the program goes to step S32 at which it is detected whether or not switch 16 is off. If switch 16 is off, the program goes to step S33 at which the detection timer starts the countdown, or continues the countdown, if it has already been started. Then, at step S34, it is detected whether the countdown is still carried out in the detection timer or not. While the countdown is carried out with switch 16 being off, the program repeats steps S30, S31, S32, S33, S34 and S40.

During this repeat, if the switch 16 is changed from off to on, the program goes from step S32 to S39 at which the detection timer is set, ready for counting another 500 milliseconds. Then, the program goes to step S40 and thereafter, the program repeats steps S30, S31, S32, S39 and S40. Then, if switch 16 is changed to off again, the program repeats steps S30, S31, S32, S33, S34 and S40, thereby effecting the countdown by the detection timer.

During the program repeat of steps S30, S31, S32, S33, S34 and S40, the detection timer counts the switch OFF-period. If the detection timer has counted down to zero without changing the switch 16 from off to on (this indicates that the toner is re-loaded), the program goes from step S34 to step S35 at which it is detected whether or not the "TONER EMPTY" is being displayed. In this case, since the "TONER EMPTY" is displayed, the program goes to step S36 at which the display "TONER EMPTY" is cancelled. Thereafter, the program goes to return (S40).

In the next cycle of operation, since "TONER EMPTY" is not displayed, the program follows steps S30, S31 and S38 at which it is detected whether switch 16 is on or not. If switch 16 is off, the program goes to step S39 for setting the detecting timer and, thereafter, it goes to step S40. In this manner, when toner is more than 86 grams and switch 16 is off, the program repeats steps S30, S31, S38, S39 and S40. Then, when switch 16 turns of, the program goes from step S38 to step S33, thereby starting the countdown by the detection timer for counting the switch ON-period.

If toner in the tank is more than 86 grams, it takes less than 500 milliseconds to change switch 16 from on to off. Thus, during the countdown of this 500 milliseconds, the program repeats steps S30, S31, S38, S33, S34 and S40. But, before completing the countdown of 500 milliseconds, switch 16 turns off, and therefore, the program goes from step S38 to S39, thereby repeating steps S30, S31, S38, S39 and S40.

On the contrary, if toner in the tank is less than 86 grams, it takes more than 500 milliseconds to change switch 16 from on to off. Thus, the above-mentioned 500 milliseconds countdown for the switch ON-period will be completed with the switch 16 being held on. In this case, the program goes from step S34 to step S35. Since "TONER EMPTY" is not being display, the program advances to step S37 for effecting the display of "TONER EMPTY". Then, the program goes to step S40. In the next cycle of operation, while switch 16 is off, the program repeats steps S30, S31, S32, S33, S34 and S40, and while switch 16 is on, the program repeats steps S30, S31, S32, S39 and S40. Thereafter, when toner is re-loaded in the tank, switch 16 will be held off for more than 500 milliseconds, and therefore, the program follows steps S30, S31, S32, S33, S34, S35, S36 and S40, as described above.

As apparent from the foregoing description, the detection whether the tank is empty or not is carried out in each cycle. Therefore, even if one error occurs in one cycle, it can be corrected immediately in the next cycle of operation. In fact, when toner in the tank is reduced nearly equal to 86 grams, the timer sometimes counts down to zero, resulting in on and off display of "TONER EMPTY". The display "TONER EMPTY" will be maintained when toner in the tank is reduced less than 86 grams. In this respect, the embodiment of the developing material amount detecting apparatus according to the present invention can give a warning, by on and off of the display, when toner in the tank is at a level deemed as empty, and a positive indication of empty, by the perpetual display of "TONER EMPTY", when toner in the tank is actually empty.

According to the embodiment of the present invention, it is possible to add the OFF-periods and/or ON-periods for a number of cycles of operations to calculate an average OFF- and/or ON-period so that toner in the tank can be detected using the average OFF- and/or ON-period.

Furthermore, according to the embodiment of the present invention, since a time length during which empty detection plate 11 is held in the first position is detected by the detection of ON-period or OFF-period of reed switch 16 for obtaining an amount of toner in the tank, the detection can be done with a high accuracy, such as indicated in FIG. 6. And, if it is required to change the toner amount to be detected, it can be simply accomplished by the change of ON- or OFF-period, or by the change of position where reed switch 16 is provided. Furthermore, since empty detection plate 11 is provided in toner supply tank 6 movably up and down between first and second positions, undesirable cross-link of toner can be avoided and, at the same time, a stable supply of toner to developing sleeve 2 can be accomplished. Moreover, the detection accuracy of the toner amount can be improved.

Also, according to the embodiment of the present invention, since toner feeding vane 9, which is necessary for toner supply means, is used for moving empty detection plate 11, it is not necessary to provide an independent driving means, resulting not only in low manufacturing cost, but also in a compact size detecting apparatus.

Furthermore, according to the embodiment of the present invention, the detection of amount of toner in the tank is carried out only when the main motor is on. Also in the case where the "TONER EMPTY" has been displayed, such a display is cancelled when it is detected that switch 16 is held off for more than a first reference period. And, in the case where the "TONER EMPTY" has not been displayed, the "TONER EMPTY" is displayed when it is detected that switch 16 is held on for more than a second reference period. In the embodiment described above, both reference periods are selected to be equal to 500 milliseconds, which is equal to ½ of one cycle period of toner feeding vane 9. However, the first and second reference periods can be selected at any different periods. For example, the first reference period representing the ON-period can be selected to be equal to 400 milliseconds and the second reference period representing the OFF-period can be selected to be equal to 600 milliseconds. In this case, the operation should be controlled by the flow chart of FIG. 7, using two timers.

According to the preferred embodiment, the first and second reference periods should meet the following requirements. In the case of the flow chart according to FIG. 8, the first reference period $t_0$ should be longer than a OFF-period $t_1$, during which switch 16 is maintained off. In other words, OFF-period $t_1$ is equal to a time span between a moment when toner feeding vane 9 engages and starts to push up the empty detection plate 11 and a moment when empty detection plate 11 drops down to the first position, provided that no toner is contained in the toner supply tank. Also, the first reference period $t_0$ should be shorter than an ON-period $T-t_1$, during which switch 16 is maintained on, wherein T is one cycle period of toner feeding vane 9. Accordingly, the following formula can be obtained.

$$t_1<t_0<T-t_1 \quad (1)$$

According to the flow chart of FIG. 8, $t_1=180$ milliseconds, $t_0=500$ milliseconds, $T=1000$ milliseconds and $T-t_1=820$ milliseconds. These figures satisfies the above formula (1).

On the contrary, in the case of the flow chart according to FIG. 7, a first reference period $t_0'$, which is set by the OFF-timer, should be longer than the above described period $t_1$, and a second reference period $t_0''$, which is set by the ON-timer, should be shorter than the above described period $T-t_1$. Accordingly, the following formulas can be obtained.

$$t_1<t_0' \quad (2)$$

$$t_0''<T-t_1 \quad (3)$$

As a difference between right and left terms in each of formulas (2) and (3) becomes small, the display "TONER EMPTY" will be produced more precisely to the amount which is deemed as empty. When such a difference is zero, the following equation can be obtained.

$$T=t_0'+t_0''$$

Under this condition, the display "TONER EMPTY" will be turned on when the toner amount decreases a certain reference level, and it will be turned off when the toner amount increases above the certain level.

In some cases, however, it is preferable to select a considerably large first reference period $t_0'$, as set by the OFF-timer, so as to satisfy the following formula.

$$T<t_0'+t_0''$$

When this relationship is met, the display "TONER EMPTY", which has been turned on by the decrease of the toner below a certain level, will be maintained even if a small amount of toner is re-loaded. The display "TONER EMPTY" can be turned off only when toner is re-loaded for more than a certain amount. Accordingly, in this case, the level for detecting the re-loaded condition of toner in the supply tank during the re-loading will be higher than the level for detecting the emptiness of toner in the tank during the decrease of toner.

According to the embodiment of the present invention, instead of gravity-drop, the return of empty detection plate 11 to the first position may be effected by a suitable biasing means, such as a coil spring. Also, empty detection plate 11 may be moved from the first position to the second position by any suitable moving means other than toner feeding vane 9. Also, instead of reed switch 16, it is possible to employ a microswitch for the detection of the first and second positions of the empty detection plate 11. Also, it is possible to change the on and off conditions of the reed switch 16.

The developing material amount detecting apparatus according to the present invention can be used for detecting the amount of developing material in a developing material collecting tank which collects the used developing material. In this arrangement, the apparatus according to the present invention may give a signal when the amount of developing material in the collecting tank exceeds a predetermined level.

According to the embodiment of the present invention, since the amount of developing material in the tank is detected by the detection of times when the switch is off and when it is on, the amount of developing material can be detected with a high accuracy and, at the same time, the setting and adjustment of the detected amount can be done simply.

Although the present invention has been fully described with reference to a preferred embodiment, many modifications and variations thereof will now be apparent to those skilled in the art, and the scope of the present invention it therefore to be limited not by the details of the preferred embodiment described above, but only by the terms of the appended claims.

What is claimed is:

1. A developing material amount detecting apparatus for detecting an amount of developing material contained in a tank comprising:

a detection member provided inside said tank movably between a first position and a second position;

means for urging said detection member towards said first position;

means for periodically sending said detection member from said first position to said second position; and means for detecting, while said sending means is actuating, the amount of said developing material inside said tank in accordance with a length of time in which said detection member is being held in said first position.

2. A developing material amount detecting apparatus as claimed in claim 1, wherein said detecting means comprises a switching means which changes its state between first and second conditions, said first condition being established when said detection member is held substantially in said first position and said second condition being established when said detection member is held substantially in a position other than said first position, and a timer means for counting at least a time length when said switching means is in either one of said first and second conditions.

3. A developing material amount detecting apparatus as claimed in claim 2, wherein said detecting means further comprises a reference time length producing means for producing a reference time length and a comparator for comparing said time length counted by said counting means with said reference time length.

4. A developing material amount detecting apparatus as claimed in claim 3, wherein said reference time length is greater than zero and smaller than one cycle length of said sending means moving periodically.

5. A developing material amount detecting apparatus for detecting an amount of developing material contained in a tank comprising:

a detection member provided inside said tank movably between a first position and a second position;

means for urging said detection member towards said first position;

means for periodically sending said detection member from said first position to said second position; and means for detecting a time length when said detection member is held substantially in said first position or in a position other than said first position, said time length representing an amount of developing material contained in said tank.

6. A developing material amount detecting apparatus as claimed in claim 5, wherein said detecting means comprises:

a switching means which is turned to a first condition when said detecting member is held substantially in said first position and is turned to a second condition when said detection member is held substantially in a position other than said first position;

a timer means for counting a predetermined time length;

means for starting said timer means when said switching means is turned to said second condition; and means for producing a signal when said switching means is maintained to said second condition for a time length longer than said predetermined time length.

7. A developing material amount detecting apparatus as claimed in claim 5, wherein said detecting means comprises:

a switching means which is turned to a first condition when said detection member is held substantially in said first position and is turned to a second condition when said detection member is held substantially in a position other than said first position;

a timer means for counting a predetermined time length;

means for starting said timer means when said switching means is turned to said first condition; and means for producing a signal when said switching means is maintained at said first condition for a time length longer than said predetermined time length.

8. A developing material amount detecting apparatus as claimed in claim 5, wherein said detecting means comprises:

a switching means which is turned to a first condition when said detection member is held substantially in said first position and is turned to a second condition when said detection member is held substantially in a position other than said first position;

a first timer means for counting a first predetermined time length;

means for starting said timer means in response to the turning of said switching means to said second condition;

means for producing a signal indicating that the amount of developing material in said tank has increased above a predetermined amount when said switching means is maintained at said second condition for a time length longer than said first predetermined time length;

a second timer means for counting a second predetermined time length;

means for starting said timer means in response to the turning of said switching means to said first condition; and means for producing a signal indicating that the amount of developing material in said tank has decreased below a predetermined amount when said switching means is maintained at said first condition for a time length longer than said second predetermined time length.

9. A developing material amount detecting apparatus as claimed in claim 8, wherein said first and second timer means are defined by a single counter.

* * * * *